US007907108B2

(12) United States Patent
Chung

(10) Patent No.: US 7,907,108 B2
(45) Date of Patent: Mar. 15, 2011

(54) SOURCE DRIVER CIRCUITS AND METHODS PROVIDING REDUCED POWER CONSUMPTION FOR DRIVING FLAT PANEL DISPLAYS

(75) Inventor: Kyu Young Chung, Seoul (KR)

(73) Assignee: Samsung Electroniccs Co., Ltd., Suwon-Si (KR)

( * ) Notice: Subject to any disclaimer, the term of this patent is extended or adjusted under 35 U.S.C. 154(b) by 1184 days.

(21) Appl. No.: 10/880,118

(22) Filed: Jun. 29, 2004

(65) Prior Publication Data

US 2005/0088394 A1 Apr. 28, 2005

(30) Foreign Application Priority Data

Oct. 28, 2003 (KR) ..... 2003-0075636

(51) Int. Cl.
*G09G 3/36* (2006.01)

(52) U.S. Cl. ..... 345/98; 345/96; 345/204

(58) Field of Classification Search ..... 345/77, 345/96, 98, 204; 365/149
See application file for complete search history.

(56) References Cited

U.S. PATENT DOCUMENTS 5,754,150 A 5/1998 Matsui
6,407,732 B1 * 6/2002 Stiens et al. ..... 345/204
6,515,892 B1 * 2/2003 Itoh et al. ..... 365/149
6,873,311 B2 * 3/2005 Yoshihara et al. ..... 345/87
2002/0126107 A1 * 9/2002 Inoue et al. ..... 345/204
2002/0190971 A1 * 12/2002 Nakamura et al. ..... 345/204
2003/0030614 A1 * 2/2003 Tajima et al. ..... 345/89
2006/0119563 A1 6/2006 Nakamura et al.

FOREIGN PATENT DOCUMENTS

CN 1388514 A 1/2003
JP 02-008813 12/1990
JP 08-271856 10/1996
JP 09-243992 9/1997
JP 2001-075536 3/2001
JP 2004-184840 7/2004
JP 2005-099170 4/2005

OTHER PUBLICATIONS

Office Action issued by the Chinese Patent Office on Dec. 4, 2009.
The First Office Action dated Dec. 28, 2007 in corresponding Chinese Application—200410082265.7.

* cited by examiner

*Primary Examiner* — Quan-Zhen Wang
*Assistant Examiner* — Calvin C Ma
(74) *Attorney, Agent, or Firm* — F. Chau & Associates, LLC

(57) ABSTRACT

Circuits and methods are provided for driving flat panel displays (e.g., a liquid crystal display (LCD)), which provide reduced power consumption for driving data lines of flat panels displays. Source driving circuits and methods for driving data lines use both intermediate reference voltages and boosted driving voltages in each driving cycle (as opposed to entirely using boosted driving voltages) to reduce power consumption and provide charge recycling.

31 Claims, 12 Drawing Sheets

POWER CONSUMPTION,
FOR AVDD:P(AVDD)=I(AVDD) X AVDD= α X I(AVDD) X VCI
FOR VGH:P(VGH)=I(VGH) X VGH= α X β X I(VGH) X VCI
FOR VGH:P(VGL)=I(VGL) X VGL= α X β X −I(VGL) X VCI
FOR VCL:P(VCL)=I(VCL) X VCL= (−I(VCL) X VCI

⇒ BOOSTED POWER CONSUMES MORE POWER FOR THE SAME CURRENT DISSIPATION

SOURCE DRIVER CIRCUITS AND METHODS PROVIDING REDUCED POWER CONSUMPTION FOR DRIVING FLAT PANEL DISPLAYS

CROSS-REFERENCE TO RELATED APPLICATION

This application claims priority to Korean Patent Application No. 2003-0075636, filed on Oct. 28, 2003, in the Korean Intellectual Property Office, which is fully incorporated herein by reference.

TECHNICAL FIELD OF THE INVENTION

The present invention relates generally to circuits and methods for driving flat panel displays (e.g., a liquid crystal display (LCD)) and, in particular, to source driver circuits and methods that provide reduced power consumption for driving data lines of flat panels displays.

BACKGROUND

Various types of flat panel displays such as liquid crystal displays (LCDs), plasma display panels (PDPs), electroluminescence display panels, etc., have been developed to replace traditional cathode ray tube (CRT) displays. Such flat panel displays are suitable for devices and applications requiring small dimension, lightweight and low power consumption. For example, LCDs can be operated using large-scale integration (LSI) drivers since LCDs can be driven by a low-voltage power supply and have low power consumption. Accordingly, LCDs have been widely implemented for laptop computers, cellular phones, pocket computers, automobiles, and color televisions, etc. The lightweight, smaller dimension, and lower power consumption features of LCD devices render such display devices suitable for use with, e.g., portable, handheld devices.

FIG. 1 is a schematic diagram that illustrates a conventional display system. The display system (10) comprises a display panel (11) (e.g., LCD) and a plurality of components for driving/controlling the display panel (11) including a source driving IC (12), a gate driving IC (13), a controller having a GRAM (graphic random access memory) (14), and a power generator (15). The controller (14) generates control signals to control the power generator (15), the source driving IC (12) and the gate driving IC (13).

The display panel (11) comprises a plurality of data lines ($D_1$~$D_n$) that are connected to the source driving IC (12) and a plurality of gate lines ($G_1$~$G_m$) that are connected to the gate driving IC (13). The display panel (11) comprises a plurality of pixels/subpixels that are arrayed in a matrix of rows and columns, wherein the pixels/subpixels in a given row are commonly connected to a gate line and wherein the pixels/subpixels in a given column are commonly connected to a data line. Depending on the application/design, one pixel/subpixel is composed in each interconnection of a gate line and data line.

Assuming the display panel (11) is a TFT-LCD, the display panel (11) would include a thin-film transistor (TFT) board comprising a plurality of pixel/subpixel units arranged in matrix form. As shown in FIG. 1, each pixel/subpixel unit comprises a TFT, a liquid crystal capacitor (Cp), which is connected between a drain electrode of the TFT and a common electrode (VCOM) and a thin-film storage capacitor (Cst), which is connected in parallel with the liquid crystal capacitor (Cp). The storage capacitor (Cst) stores an electric charge so that an image on the display is maintained during a non-selected period. The liquid crystal capacitor (Cp) is formed by a common electrode ($V_{COM}$) of a color filter plate, a pixel electrode of the TFT and liquid crystal material therebetween. A source electrode of the TFT is connected to a data line and a gate electrode of the TFT is connected to a gate line. The TFT acts as a switch that applies a source voltage on the data line to the pixel electrode when a gate driver signal $V_{GH}$ on the gate line is applied to the gate of the TFT.

The power generator (15) generates a plurality of reference voltages, including, AVDD (source driver power supply) and GVDD (gamma reference voltage), which are applied to the source driving IC (12), VCOMH (high common electrode voltage) and VCOML (low common electrode voltage), which are applied to the common voltage electrode (VCOM) of the panel (11), and $V_{GH}$(gate driver turn-on voltage) and $V_{GOFF}$ (gate driver turn-off voltage), which are applied to the gate driving IC (13) to drive selected gate lines.

The controller (14) receives as input a plurality of driving data signals and driving control signals that are output from an image supply source (e.g., a main board of a computer). The driving data signals comprise R, G, B data for forming an image on the display (11). The driving control signals comprise vertical synchronous signals (Vsynch), horizontal synchronous signals (Hsync), a data enable signal (DE) and a clock signal (Clk). The controller (14) outputs to the source driving IC (12) a plurality of display data signals (DDATA), which correspond to R, G, B data, and a source control signals. The controller (14) outputs a gate control signals to control the gate driving IC (13). The controller (14) controls the timing for which data and control signals are output from the source driving IC (12) and gate driving IC (13). For example, in one mode of operation, the controller (14) generates the source and gate control signals such that the gate driving IC (13) transmits a gate driver output signal $V_{GH}$ to each gate line (G1~Gm) in a consecutive manner and data voltage is selectively applied to each pixel/subpixel in an activated row one by one in order. In another mode of operation, the pixels/subpixels can be charged by sequentially scanning pixels/subpixels in a first column and thereafter scanning pixels/subpixels in a next column.

The gate driving IC (13) comprises a plurality of gate drivers that each drive a corresponding gate line $G_1$~$G_m$. The source driving IC (12) comprise a plurality of source driver circuits (12-1~12-n), or more generally, 12(i), which drive corresponding data lines $D_1$~$D_n$. FIG. 2 schematically illustrates a conventional source driver circuit (20), which can be implemented in the system (10) of FIG. 1 for driving the data lines of the display panel (11). In general, as depicted in FIG. 2, the source driver circuit (20) comprises a source driver (12-i) that drives a corresponding data line ($D_i$), and a grayscale voltage generator (23). The source driver circuit (20) of FIG. 2 illustrates a conventional architecture of the source driver IC (12) of FIG. 1, wherein there is one source driver (12-i) for each data line (or RGB channel). The grayscale generator (23) can be implemented in the power generator circuit (15) of FIG. 1. The output of the grayscale generator (23) is commonly applied to each source driver (12-1~12-n) of the source driver IC (12).

In general, the source driver (12-i) comprises a polarity reverse circuit (21), a latch circuit (22), a gamma decoder (24), and a driving buffer (25). The source driver (12-i) is controlled by a plurality of control signals, including a polarity control signal M, a latch control signal S_Latch, and mode control signals GRAY_ON (gradient mode enable signal) and BIN_ON (binary mode enable signal), each of which will be explained below. Moreover, the source driver (12-i) receives as input grayscale reference voltages that are generated by the grayscale voltage generator (23).

The source driver (12-i) receives as input an n-bit block of display data (DDATA) for R, G or B data from the GRAM (14). The polarity reverse circuit (21) receives the display data block (DDATA) and controls a polarity of the n-bits in response to the polarity control signal M. For example, if the polarity control signal M is logic "0", the polarity of the display data (DDATA) will remain the same (original display data (positive polarity)). On the other hand, if the polarity control signal M is logic "1", the polarity of the display data (DDATA) will be reversed (inverted display data (negative polarity)). In the embodiment of FIG. 2, the polarity reverse circuit (21) is implemented using an exclusive-OR (XOR) gate.

The latch circuit (22) latches the n-bit data block output from the polarity reverse circuit (21) in response to a latch control signal S_LATCH. In the embodiment of FIG. 2, the latch circuit (22) is implemented using a clocked n-bit D latch. The latch circuit (22) latches and outputs a latched display data block CD[n-1:0] to the gammna decoder (24). The gray scale voltage generator (23) generates and outputs $2^n$ different grayscale reference voltages (VG[$2^n$-1:01])to the gamma decoder (24). The gamma decoder (24) decodes the n-bit display data block CD[n-1:0] output from the latch circuit (22), and selects and outputs a grayscale voltage to the driving buffer (25). For each pixel (comprising RGB subpixels), the number of possible grayscales (or different colors) that can be generated for each pixel with the n-bit grayscale architecture is $2^n(R)2^n(G)2^n(B)=2^{3n}$.

The driving buffer (25) comprises a first driver (26), a first driver output switch (S1), and a second driver (27). The first driver (26) buffers and amplifies a grayscale voltage output from the gamma decoder (24) and the second driver (27) buffers and amplifies the MSB (most significant bit), CD[n-1], of the latched display data CD[n-1:0]. The driving buffer (25) generates a source driver output signal Sn for driving a corresponding data line $D_i$, which will vary depending on selected mode of operation, i.e., binary mode (8-color mode) or gradient mode ($2^{3n}$-color mode).

For instance, in gradient mode, a GRAY_ON control signal is enabled (logic "1") to activate (close) the switch S1, thereby allowing the first driver (26) to output a buffered grayscale voltage. Further, in gradient mode, a BIN_ON control signal (which is applied to the second driver (27)) is disabled (logic "0") to deactivate (turn off) the second driver (27). On the other hand, in binary mode, the GRAY_ON control signal is disabled (logic "0") to deactivate (open) the switch S1, thereby preventing the first driver (26) from outputting a buffered grayscale voltage as Sn, and the BIN_ON control signal is enabled (logic "1") to activate the second driver (27). In binary mode, the second driver (27) will output a source driver output signal Sn of AVDD (power supply voltage for source driver) or AVSS (ground voltage for source driver), depending on the logic level of the most significant bit CD[n-1] of the latched display data CD[n-1:0].

FIG. 3 is a timing diagram illustrating a binary mode of operation of the source driver circuit of FIG. 2. In FIG. 3, it is assumed that the resolution of the RGB data is 6 bits (i.e., n=6) and that latched display data CD[n-1:0] having values 00H (binary 000000), 3FH(binary 111111), 07H(binary 000111) and 19H(binary 011001) are successively output from the latch (22). As shown in FIG. 3, in binary mode, BIN_ON is fixed at logic "1" and GRAY_ON is fixed at logic "O". As such, the switch S1 is open and the second driver (27) is activated.

As further depicted in FIG. 3, before time $T_1$, the latched display data CD[5:0] of value 00H has a most significant bit CD[5]=logic "0", which results in a source driver output signal Sn of AVSS (ground for the source driver) being output from the second driver (27). At time $T_1$, a latch control pulse S_LATCH results in a latched display data CD[5:0]=3FH, which has a most significant bit CD[5]=logic "1". In response, the source driver output signal Sn (output from the second driver (27)) transitions from AVSS to AVDD (the power supply voltage level for the source driver). Then, at time $T_2$, a latch control pulse S_LATCH results in a latched display data CD[5:0]=07H, which has a most significant bit CD[5]=logic "0". In response, the source driver output signal Sn output from the second driver (27) transitions from AVDD to AVSS. Then, at time $T_3$, a latch control pulse S_LATCH results in a latched display data CD[5:0]=19H, which has a most significant bit CD[5]=logic "0". In response, the source driver output signal Sn remains at AVSS.

FIG. 4 is a timing diagram illustrating a gradient mode of operation of the source driver circuit of FIG. 2. In FIG. 4, it is assumed that the resolution of the RGB data is 6 bits (i.e., n=6) and that latched display data blocks CD[n-1:0] having values 00H (binary 000000), 3FH (binary 111111), 07H (binary 000111) and 19H (binary 011001) are successively output from the latch (22). As shown in FIG. 4, in binary mode, BIN_ON is fixed at a logic "0" and GRAY_ON is fixed at logic "1". As such, the second driver (27) is deactivated, the switch S1 is activated (closed) and the first driver (26) buffers and outputs as Sn, the grayscale voltage selected by the decoder (24).

More specifically, as depicted in the exemplary diagram of FIG. 4, before time $T_1$, the latched display data CD[5:0]=00H results in a source driver output signal Sn of value VG[0]. At time $T_1$, a latch control pulse S_LATCH results in a latched display data block CD[5:0]=3FH, which causes Sn to transition from VG[0] to VG[63]. Then, at time $T_2$, a latch control pulse S_LATCH results in a latched display data CD[5:0]=07H, which causes Sn to transition from VG[63] to VG[7]. Then, at time $T_3$, a latch control pulse S_LATCH results in a latched display data CD[5:0]=19H, which causes the source driver output signal Sn to transition from VG[7] to VG[25].

FIG. 5 schematically illustrates a conventional common voltage driver circuit (30), which is implemented in the system (10) of FIG. 1 for driving the common electrode (VCOM) of the display panel (11). In general, the common voltage driver (30) comprises first and second drivers (31) and (32), switches (33) and (34) and capacitors (35) and (36). The first driver (31) buffers and outputs VCOMH (high common voltage). As explained below, a VCOMH voltage generator in the power generating circuit (15) generates VCOMH from AVDD power. The capacitor (35) is connected to the output of the first driver (31) to stabilize the output voltage. The switch (33) is controlled by control signal VCMH_ON to selectively connect the output of the first driver (31) to a VCOM node N and drive VCOM to a high common voltage VCOMH.

The second driver (32) buffers and outputs VCOML (low common voltage). As explained below, a VCOML voltage generator in the power generating circuit (15) generates VCOML from VCL (−VCI) power. The capacitor (36) is connected to the output of the second driver (32) to stabilize the output voltage. The switch (34) is controlled by a control signal VCML_ON to selectively connect the output of the second driver (32) to the VCOM node N and drive VCOM to VCOML.

FIG. 6 is an exemplary timing diagram illustrating a conventional method for driving a common electrode using the circuit of FIG. 5. Referring to FIG. 6, at time $T_1$, the polarity control signal M and control signal VCMH_ON are enabled and the control signal VCML_ON is disabled. As a result, switch (33) is activated and switch (34) is deactivated and VCOM is driven to VCOMH from VCOML by the first driver (31). At time $T_2$, the polarity control signal M and control signal VCMH_ON are disabled and the control signal VCML_ON is enabled. As a result, switch (33) is deactivated and switch (34) is activated and VCOM is driven to VCOML from VCOMH by the second driver (32).

When display systems such as LCD panels are implemented in small hand-held, portable devices, it is important to reduce the power consumption needed to drive such displays so as to preserve battery power. In general, the primary sources of power consumption for driving flat panel displays include source drivers and VCOM drivers. More specifically, with source drivers, the voltages for driving the data lines are typically designed with relatively high levels in order to enhance the driving speed of the display (e.g., quickly charge the liquid crystal capacitor Cp). However, an increased driving voltage increases power consumption of the display in proportion to the voltage rise of the driving voltage. Further, driving the common electrode (which faces the pixel electrodes) is a significant source of power consumption because the polarity of the common voltage is reversed every cycle.

Typically, source and VCOM driving voltages are internal voltages that are generated by voltage generators that generate such driving voltages by boosting voltage/power output from an intermediate reference voltage source. For example, FIG. 7 is a block diagram illustrating a conventional architecture of the power generator (15) in FIG. 1. In general, the power generator (15) generates a plurality of internal reference voltages using an intermediate reference voltage VCI supply source. More specifically, the power generator (15) comprises a first power generator (15-1) that generates AVDD (source driver power supply voltage) by boosting an intermediate input voltage VCI by a predetermined amount $\alpha$ (which is greater than 1). The AVDD voltage is applied to the source driver (12), and is input to other power generators (not shown) to generate GVDD and VCOMH. A second power generator (15-2) receives the reference voltage AVDD as input and generates VGH by boosting AVDD by an amount $\beta$. A third power generator (15-3) receives the reference voltage VGH as input and generates VGL=−VGH. A fourth power generator (15-4) receives the intermediate reference voltage VCI as input and generates VCL=−VCI.

One problem associated with the conventional source and VCOM driver circuits is the significant power consumption that occurs due to the use of boosted power to drive the data lines and VCOM. More specifically, by way of example with reference to FIG. 2, the first and second drivers (26) and (27) in the driving buffer (25) use boosted AVDD power to drive the data line, and in FIG. 5, the boosted AVDD power is used for generating VCOMH (high common voltage) and driving the common electrode VCOM of the display panel (11). For AVDD, the power consumption is $P_{AVDD}=I_{AVDD}\cdot AVDD=\alpha\cdot I_{AVDD}\cdot VCI$ and the driving current $I_{AVDD}$ is supplied from the intermediate power supply VCI. Although the current dissipation for driving current $I_{AVDD}$ is derived from VCI power, the actual power consumption based on AVDD power is greater when $\alpha>1$. Accordingly, the boosted power for AVDD and VCOMH for driving the data lines and VCOM effectively results in more power consumption for the same current dissipation $I_{AVDD}$.

SUMMARY OF THE INVENTION

Exemplary embodiments of the invention include circuits and methods for driving flat panel displays (e.g., a liquid crystal display (LCD)) and, in particular, to source driver circuits and methods that provide reduced power consumption for driving data lines of flat panels displays. In general, exemplary embodiments of the invention include circuits and methods for driving data lines using both intermediate reference voltages and boosted driving voltages in each driving cycle (as opposed to entirely using boosted driving voltages) to reduce power consumption and provide charge recycling.

In one exemplary embodiment of the invention, a source driving circuit for driving a data line of a display includes: a source driver circuit that receives display data and generates a source driving voltage corresponding to the received display data, and applies the source driving voltage to a data line of a display; a voltage generator circuit that generates an intermediate source driving voltage; and a control circuit that applies the intermediate source driving voltage to the data line to drive the data line to the intermediate source driving voltage before the source driving voltage is applied to the data line by the source driver circuit to drive the data line from the intermediate source driving voltage to the source driving voltage.

In another exemplary embodiment, the control circuit includes a comparator that compares the received display data with previously received display data and generates a comparison signal, and a switch that is responsive to the comparison signal to selectively apply the intermediate source driving voltage from the voltage generator circuit to the data signal line. The control circuit comprises a latch that outputs the previously received display data to the comparator. In one exemplary embodiment, the comparator compares a most significant bit of the received display data with a most significant bit of the previously received display data and generates a control signal to deactivate the switch when the most significant bits of the received display data and the previously received display data are the same.

In another exemplary embodiment of the invention, a circuit for driving a data line of a display includes: a polarity control circuit that receives an n-bit display signal and a polarity control signal, and either reverses or maintains a polarity of the n-bit display signal in response to the polarity control signal; a first latch that latches the n-bit display signal output from the polarity control circuit in response to a first latch control signal; a decoder that receives as input a plurality of gray scale reference voltages and the n-bit display signal output from the first latch, and decodes the n-bit display signal to selectively output one of the gray scale reference voltages; a buffer circuit that generates a source driving voltage and applies the source driving voltage to a data line of a display, wherein in a first mode of operation, the buffer circuit is responsive to a first mode control signal to generate the source driving voltage from the gray scale reference voltage output from the decoder, and wherein in a second mode of operation, the buffer circuit is responsive to a second mode control signal to generate the source driving voltage based on a most significant bit of the n-bit display signal output from the first latch; a voltage generator circuit that generates an intermediate source driving voltage; and a control circuit that applies the intermediate source driving voltage to the data line to drive the data line to the intermediate source driving voltage before the source driving voltage is applied to the data line by the buffer circuit to drive the data line from the intermediate source driving voltage to the source driving voltage.

These and other exemplary embodiments, aspects, features and advantages of the present invention will be described and become apparent from the following detailed description of exemplary embodiments, which is to be read in connection with the accompanying drawings.

DETAILED DESCRIPTION OF EXEMPLARY EMBODIMENTS

Exemplary embodiments of the invention will be described hereafter, which include source driver and VCOM driver circuits and methods that provide reduced power consumption for driving data lines and common voltage electrodes of flat panel displays. In general, exemplary embodiments of the invention include circuits and methods for driving data lines and common electrodes using both intermediate reference voltages and boosted driving voltages in each driving cycle (as opposed to entirely using boosted driving voltages as in the conventional methods) to reduce power consumption and provide charge recycling.

Figure 1:
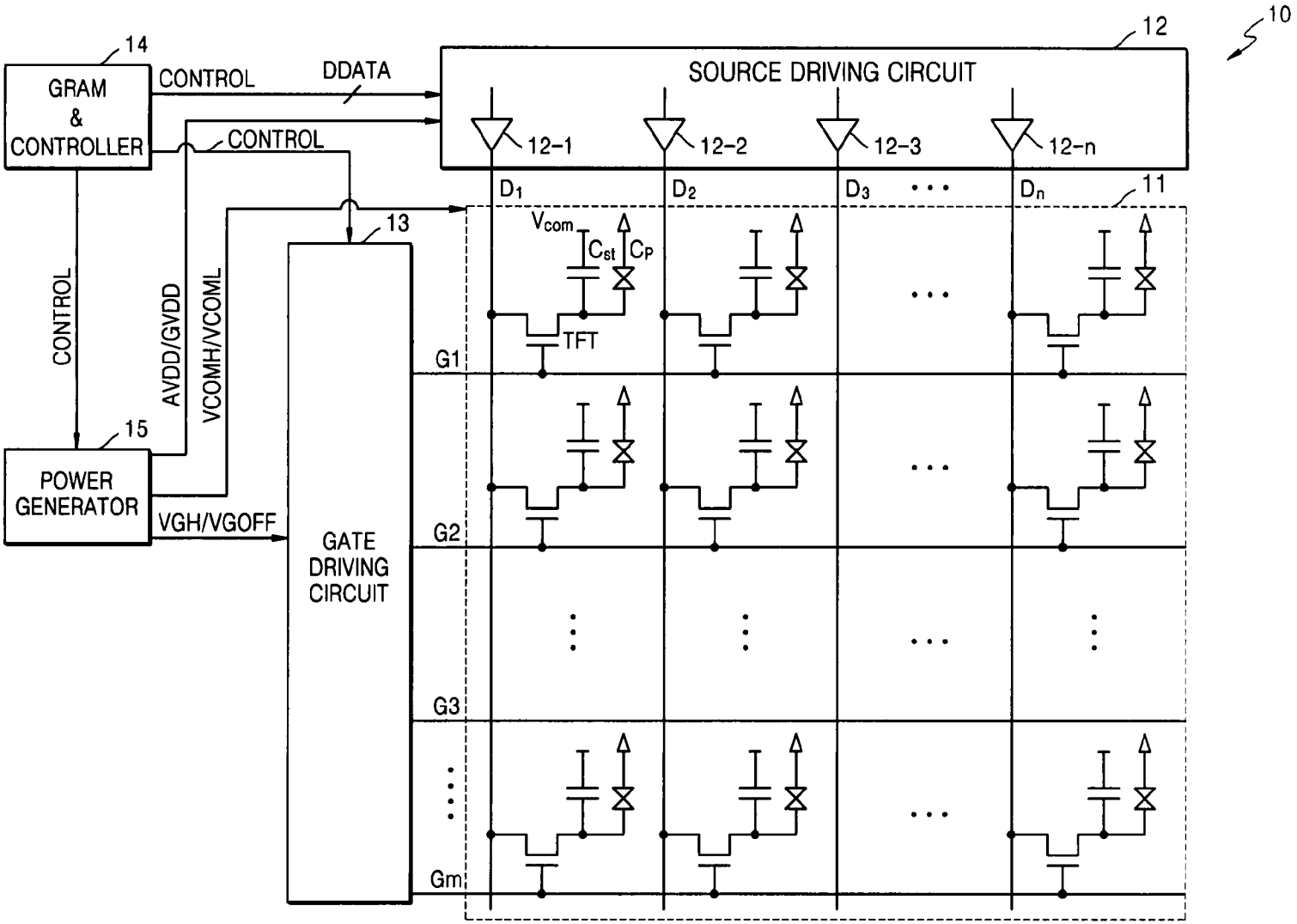
FIG. 1 (PRIOR ART)
FIG. 1 is a schematic diagram that illustrates a conventional display system.
Figure 8:
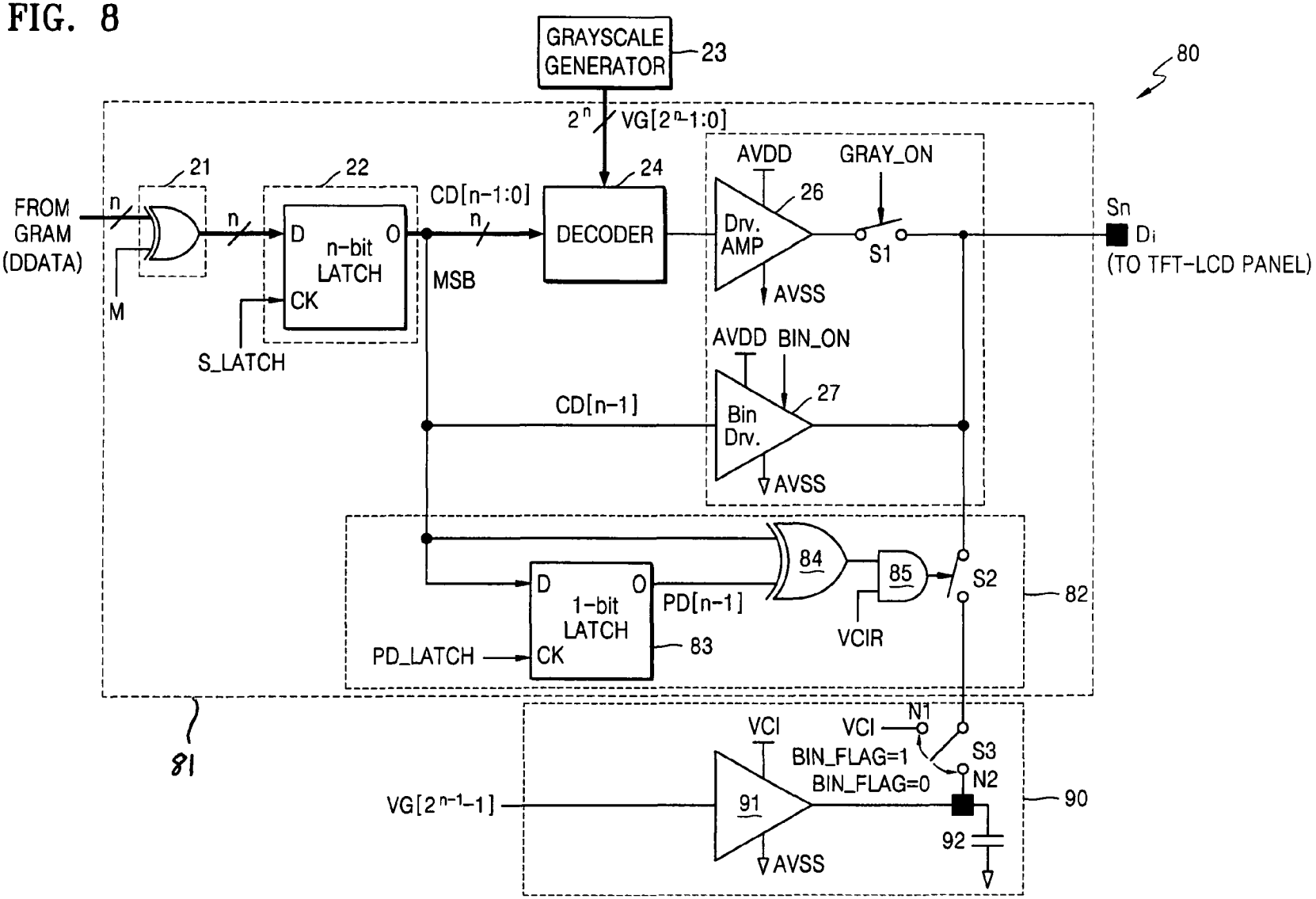
FIG. 8 is a schematic diagram that illustrates a source driving circuit for driving data lines according to an exemplary embodiment of the invention.

Referring now to FIG. 8, a schematic diagram illustrates a source driving circuit (80) according to an exemplary embodiment of the invention. The exemplary embodiment depicted in FIG. 8 is an extension of the source driving circuit (20) depicted in FIG. 2, which provides a significant reduction in power consumption for driving data lines of a display panel. In general, the source driving circuit (80) comprises a source driver (81) that generates a source driver output signal Sn to drive a corresponding data line $D_i$e, a grayscale generator (23) and an intermediate voltage generator (90). The source driving circuit (80) of FIG. 8 illustrates an architecture according to one exemplary embodiment, which can be implemented for the source driving IC (12) in the display system (10) of FIG. 1, wherein there is one source driver (81) for each data line Di (or RGB channel), and wherein the grayscale generator (23) and intermediate voltage generator (90) are commonly implemented for all source drivers.

Figure 2:
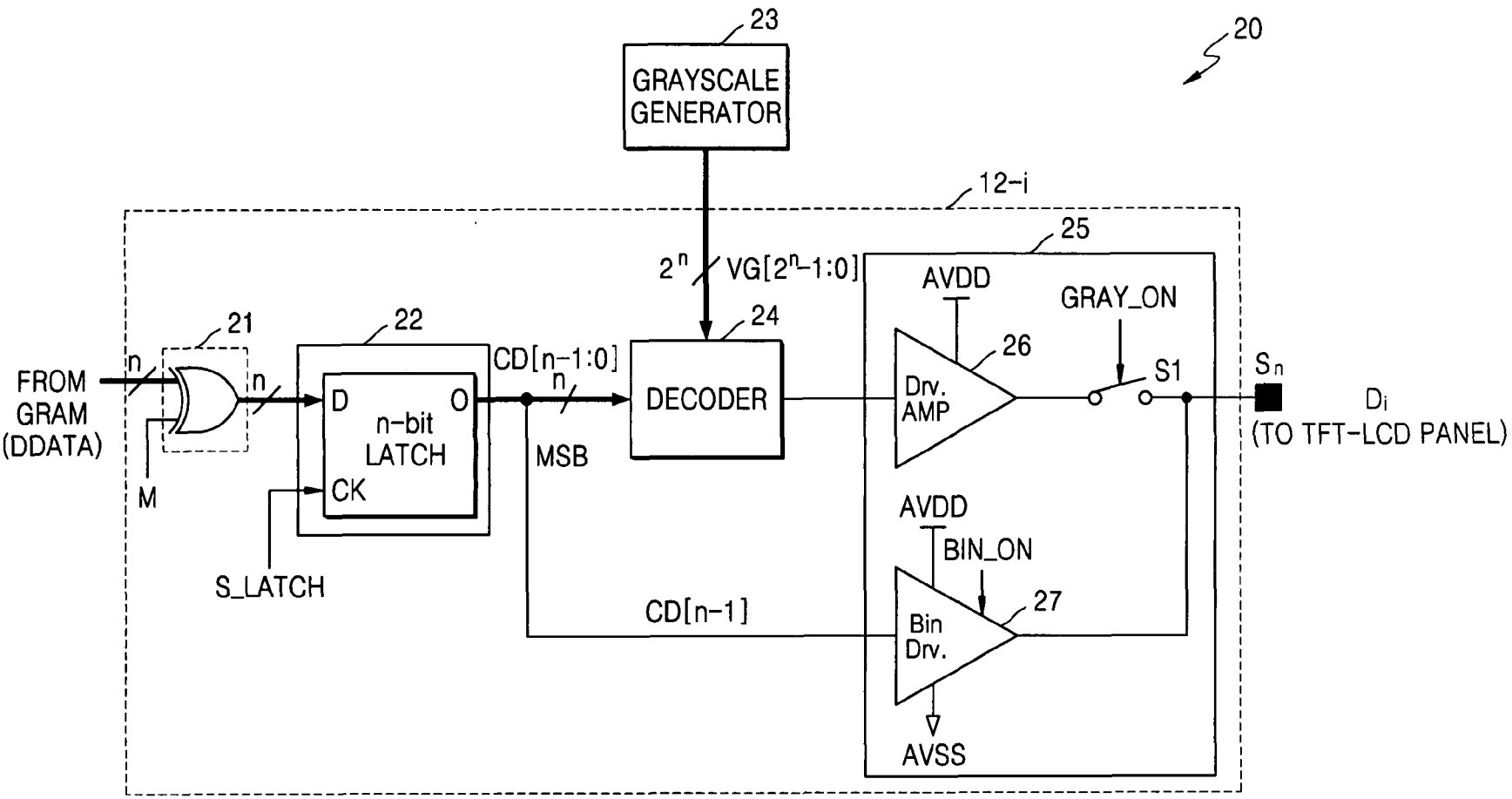
FIG. 2 (PRIOR ART)
FIG. 2 is a schematic diagram that illustrates a conventional source driver circuit.

The source driver (81) is similar in architecture to the source driver (12-i) of FIG. 2 in that the source driver (81) comprises a polarity reverse circuit (21), a latch circuit (22), a gamma decoder (24), and a driving buffer circuit (25), which operate in a similar manner as described above. However, the source driver (81) further comprises a comparison circuit (82) that compares a current MSB with a previous MSB and connects the data line $D_i$ to an intermediate voltage output from the intermediate voltage generator (90) depending on the comparison results. The intermediate voltage generator (90) outputs different intermediate voltages depending on the mode of operation (binary or gradient).

More specifically, the comparison circuit (82) comprises a latch circuit (83), an XOR circuit (84), an AND gate (85) and a switch device (S2). In one exemplary embodiment, the latch circuit (83) comprises a 1-bit clocked D latch that is responsive to a latch control signal PD_LATCH to latch a most significant bit CD[n-1] of a currently latched block of display data stored in the latch (22) and output a most significant bit PD[n-1] of previously latched display data in response to a latch control pulse PD_LATCH.

The XOR gate (84) receives as input a current MSB CD[n-1] of a current block of display data CD[n-1:0] in latch (22) and a previously latched MSB PD[n-1] output from the latch (83). The XOR gate (84) will output a logic "1" when the current and previous MSBs are different and a logic "0" when the current and previous MSBs are the same. The AND gate (85) comprises a two-input AND gate that receives the output of the XOR gate (84) and a control signal VCIR (gating signal). In effect, the AND gate (85) functions as a gating circuit that transfers the output of the XOR gate (84) in response to the gating signal VCIR to control activation/deactivation of the switch S2. In one exemplary embodiment of the invention, the switch S2 is activated (closed) when the output of the AND gate is logic "1" (the current MSB CD[n-1] and the previous MSB PD[n-1] are different) and the switch S2 is deactivated (opened) when the output of the AND gate is logic "0" (the current MSB CD[n-1] and the previous MSB PD[n-1] are the same). As explained in detail hereafter, when the switch S2 is activated, an intermediate voltage output from the intermediate voltage generator (90) is applied to drive the data line Di. According to an embodiment of the present invention, it is to be appreciated that the XOR gate (84) and the AND gate (85) can be exchanged to the other logic gates which have the same Boolean functions of the XOR gate (84) and the AND gate (85).

The intermediate voltage generator (90) comprises a third driver (91) (amplifier), a switch S3 and optionally a capacitor (92). The third driver (91) buffers and outputs one of the gray scale reference voltages VG output from the grayscale generator (23) using VCI power. In one exemplary embodiment, the third driver (91) receives as input the grayscale reference voltage VG[$2^{n-1}$−1] (which is preferably lower than a reference voltage VCI). The switch S3 is response to a voltage selection control signal BIN_FLAG to connect the switch S3 to a first node N1 to which a first intermediate voltage (VCI) is applied, or to connect the switch S3 to a second node N2 (i.e., the output of the third driver (91)) to which a second intermediate voltage (VG[$2^{n-1}$−1]) is applied. The capacitor (92) may optionally be connected to the output of the third driver (91) to stabilize the output voltage.

In one exemplary embodiment of the invention, the intermediate source driving voltage VCI is in a range of about ½ to about ⅓ of a full-swing voltage of the source driving voltage AVDD. For example, AVDD may be about 5-6V, VCI may be about 2-3V and AVSS is about 0V (ground).

In binary mode, a voltage selection control signal BIN_FLAG=logic "1" which causes S3 to connect to the first node N1 to transfer the intermediate voltage VCI to S2. In a gradient mode, a voltage selection control signal BIN_FLAG=logic "0" causes S3 to connect to the output node N2 of the third driver (91) to transfer the second intermediate voltage, e.g., $VG[2^{n-1}-1]$, to S2. The respective control signals, M, S_LATCH, BIN_ON, GRAY_ON, VCIR, BIN_FLAG are generated by a controller, such as the controller (14) in FIG. 1. As noted above, the intermediate voltage generator (90) is commonly used by all source drivers (81) in a source driver IC.

Figure 9:
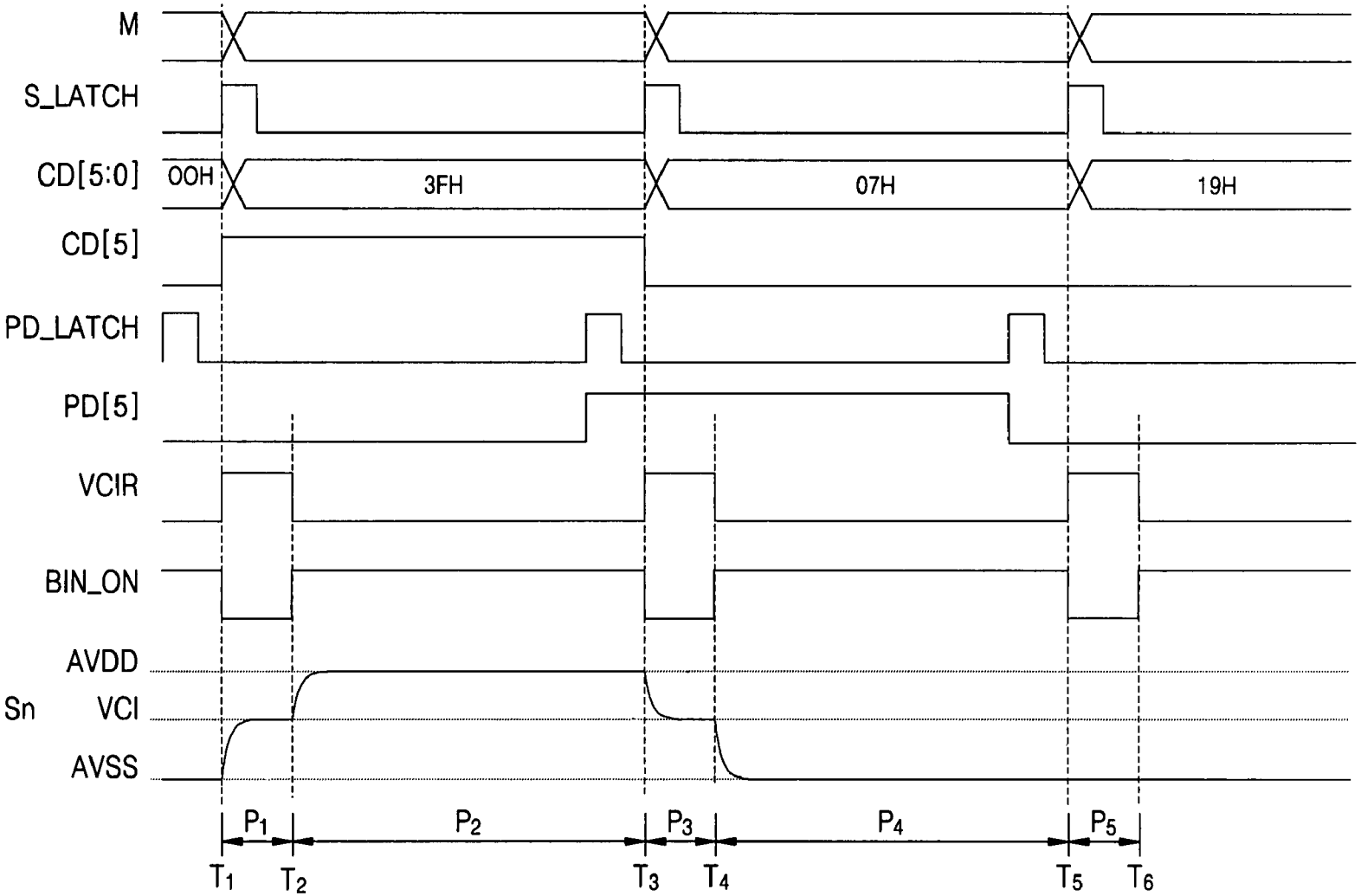
FIG. 9 is an exemplary timing diagram illustrating a binary mode of operation of the source driving circuit of FIG. 8, according to an exemplary embodiment of the invention.

FIG. 9 is an exemplary timing diagram illustrating a source driving method for driving data lines according to an exemplary embodiment of the invention. For purposes of illustration, the exemplary method of FIG. 9 will be described with reference to the source driving circuit (80) of FIG. 8. In particular, the method of FIG. 9 can be viewed as a binary mode of operation of the source driver circuit of FIG. 8 according to one exemplary embodiment of the invention. In FIG. 9, it is assumed that the resolution of the RGB data is 6 bits (i.e., n=6) and that blocks of latched display data having values 00H (binary 000000), 3FH (binary 111111), 07H (binary 000111) and 19H (binary 011001) are successively output from the latch (22). It is further assumed that in binary mode, GRAY_ON is fixed at logic "O" (the switch S1 is open) and BIN_FLAG is fixed at logic "1" (switch S3 is connected to the VCI node N1).

As depicted in FIG. 9, before time T1, latched block of display data CD[5:0]=00H is latched and output from n-bit latch circuit (22), which has a most significant bit CD[5]= logic "0". In addition, before time T1, BIN_ON=logic "1" and the second driver (27) is turned on. With the most significant bit CD[5]=logic "0", the second driver (27) outputs a source driver output signal Sn of AVSS (ground for source driver) to the data line Di. A control pulse PD_LATCH activated before time $T_1$ causes the 1-bit latch (83) to latch the most significant bit (CD[5]=logic "0") of the display data (00H) and output PD[5]=logic "0". As shown in FIG. 9, the latch control signal PD_LATCH is activated before the latch control signal S_LATCH is activated for latching a next (current) block of display data.

Then, at time $T_1$, the latch control signal S_LATCH is activated, which causes the latch (22) to latch and output a block of display data CD[5:0]=3FH, which has a most significant bit CD[5]=logic "1". Further, at time T1 and for a period $P_1$, the gating signal VCIR is activated and BIN_ON is deactivated. With BIN_ON deactivated, the second driver (27) is turned off. Further, with VCIR activated, the output of the XOR gate (84) is gated to the switch S2. Since the current and previous MSBs are different (i.e., CD[5]=1 and PD[5]= 0), the output of the AND gate is logic "1" which activates S2. With S2 activated (closed) and the second driver turned off, the VCI supply voltage drives the data line Di with a source driver output signal Sn from AVSS to the intermediate voltage VCI during period P1.

Then, at time T2, VCIR is deactivated and BIN_ON is activated, which causes the switch S2 to open (to disconnect VCI from the data line Di) and the second driver (27) to turn on. With the current most significant bit CD[5]=logic "1", the second driver (27) drives the output signal Sn from VCI to AVDD during time period P2. Near the end of period P2, but before time T3, PD_LATCH is activated, which causes the 1-bit latch (83) to latch the MSB of the display data (3FH) (CD[5]=logic "1") and output PD[5]=logic "1".

Then, at time T3, S_LATCH is activated, which causes the n-bit latch (22) to latch in and output a current block of display data CD[5:0]=07H, which has a most significant bit CD[5]=logic "0". Further, at time T3 and for period $P_3$, the gating signal VCIR is activated and BIN_ON is deactivated. With BTN_ON deactivated, the second driver (27) is turned off. Further, with VCIR activated, the output of the XOR gate (84) is gated to the switch S2. Since the current and previous MSBs are different (i.e., CD[5]=0 and PD[5]=1), the output of the AND gate is logic "1" which activates S2. With S2 activated, the data line Di is connected to the VCI power supply, which discharges the source driver output signal Sn from AVDD to the intermediate voltage VCI.

Then, at time T4, VCIR is deactivated and BIN_ON is activated, which causes the switch S2 to open (to disconnect VCI from the data line Di) and the second driver (27) to turn on. With CD[5]=0, the second driver (27) drives Sn from VCI to AVSS during time period P4. Near the end of period P4, but before time T5, PD_LATCH is activated, which causes the 1-bit latch (83) to latch the MSB (CD[5]=logic "0") of the display data (07H) and output PD[5]=logic "0".

Then, at time T5, S_LATCH is activated, which causes the n-bit latch (22) to latch and output a current block of display data CD[5:0]=19H, which has a most significant bit CD[5]= logic "0". During a time period $P_5$, the gating signal VCIR is activated and BIN_ON is deactivated. With BIN_ON deactivated, the second driver (27) is turned off. Further, with VCIR activated, the output of the XOR gate (84) is gated to the switch S2. Since the current and previous MSBs are the same (i.e., CD[5]=0 and PD[5]=0), the output of the AND gate is logic "0" which maintains S2 in a state of deactivation. With S2 deactivated, the source driver output signal Sn remains at AVSS (i.e., not charged to VCI). Thereafter, after time T6, VCIR is deactivated and BIN_ON is activated. With CD[5]= 0, the second driver (27) maintains Sn at AVSS.

Figure 10:
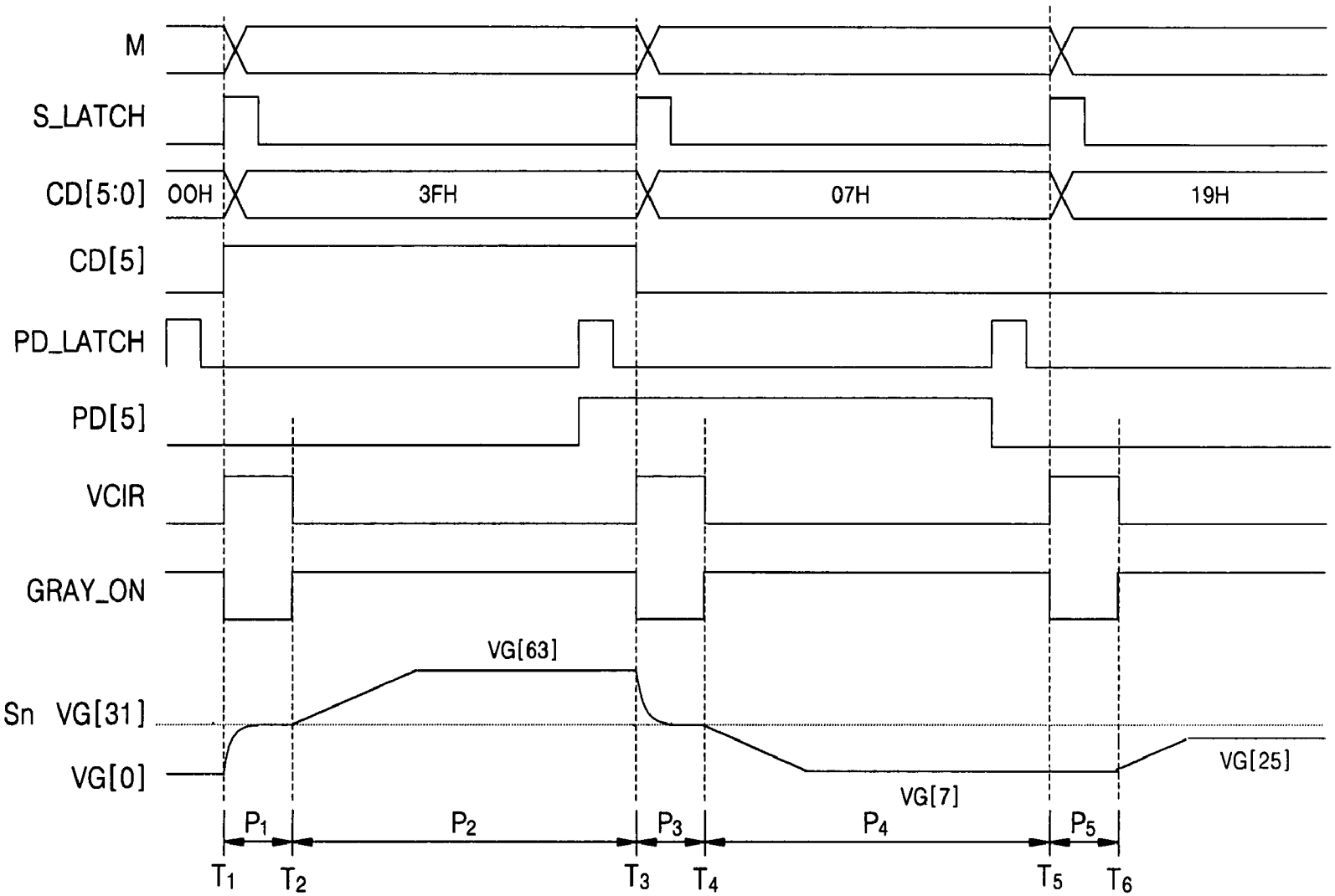
FIG. 10 is an exemplary timing diagram illustrating a gradient mode of operation of the source driving circuit of FIG. 8, according to an exemplary embodiment of the invention.

FIG. 10 is an exemplary timing diagram illustrating a source driving method for driving data lines according to another exemplary embodiment of the invention. For purposes of illustration, the exemplary method of FIG. 10 will be described with reference to the source driving circuit (80) of FIG. 8. In particular, the method of FIG. 10 can be viewed as a gradient mode of operation of the source driver circuit of FIG. 8 according to an exemplary embodiment of the invention. In FIG. 10, it is assumed that the resolution of the RGB data is 6 bits (i.e., n=6) and that blocks of latched display data having values 00H (binary 000000), 3FH (binary 111111), 07H (binary 000111) and 19H (binary 011001) are successively output from the latch (22). It is further assumed that in gradient mode mode, BIN_ON is fixed at logic "0" (the second driver (27) is deactivated) and BIN_FLAG is fixed at logic "0" (switch S3 is connected to the node N2, the output of the third driver (91)).

As depicted in FIG. 10, before time T1, latched block of display data CD[5:0]=00H is latched and output from n-bit latch circuit (22), which has a most significant bit CD[5]= logic "0". In addition, before time T1, GRAY_ON=logic "1" and switch S1 is closed, and the first driver (26) is driving the data line Di with an output signal Sn at some grayscale voltage VG, which is less than the intermediate voltage VG[31]. A control pulse PD_LATCH activated before time $T_1$, causes the 1-bit latch (83) to latch the most significant bit (CD[5]= logic "0") of the display data (00H) and output PD[5]= logic "0". As shown in FIG. 10, the latch control signal PD_LATCH is activated before the latch control signal S_LATCH is activated for latching a next (current) block of display data.

Then, at time $T_1$, the latch control signal S_LATCH is activated, which causes the latch (22) to latch and output a block of display data CD[5:0]=3FH, which has a most significant bit CD[5]=logic "1". Further, at time T1 and for a period $P_1$, the gating signal VCIR is activated and GRAY_ON is deactivated. With GRAY_ON deactivated, the switch S1 is open. Further, with VCIR activated, the output of the XOR gate (84) is gated to the switch S2. Since the current and previous MSBs are different (i.e., CD[5]=1 and PD[5]=0), the output of the AND gate is logic "1" which activates S2. With switch S2 activated (closed) and switch S1 open, the third driver (91) drives the data line Di with a source driver output signal Sn from VG[0] to the intermediate voltage VG[31] during period P1.

Then, at time T2, VCIR is deactivated and GRAY_ON is activated, which causes the switch S2 to open (to disconnect the output of the third driver (91) from the data line Di) and the switch S1 to close. With CD[5:0]=3FH, the first driver (26) drives the output signal Sn from VG[31] to VG[63] during time period P2. Near the end of period P2, but before time T3, PD_LATCH is activated, which causes the 1-bit latch (83) to latch the MSB of the display data (3FH) (CD[5]= logic "1") and output PD[5]=logic "1".

Then, at time T3, S_LATCH is activated, which causes the n-bit latch (22) to latch in and output a current block of display data CD[5:0]=07H, which has a most significant bit CD[5]=logic "0". Further, at time T3 and for period $P_3$, the gating signal VCIR is activated and GRAY_ON is deactivated. With GRAY_ON deactivated, the switch S1 opens, and with VCIR activated, the output of the XOR gate (84) is gated to the switch S2. Since the current and previous MSBs are different (i.e., CD[5]=0 and PD[5]=1), the output of the AND gate is logic "1" which activates S2. With S2 activated, the data line Di is connected to node N2, and the driver (91) discharges the source driver output signal Sn from VG[63] to the intermediate voltage VG[31].

Then, at time T4, VCIR is deactivated and GRAY_ON is activated, which causes the switch S2 to open (to disconnect node N2 from the data line Di) and the switch S1 to close. With CD[5:0]=07H, the first driver (26) drives Sn from VG[31] to VG[7] during time period P4. Near the end of period P4, but before time T5, PD_LATCH is activated, which causes the 1-bit latch (83) to latch the MSB (CD[5]= logic "0") of the display data (07H) and output PD[5]=logic "0".

Then, at time T5, S_LATCH is activated, which causes the n-bit latch (22) to latch and output a current block of display data CD[5:0]=19H, which has a most significant bit CD[5]= logic "0". During a time period $P_5$, the gating signal VCIR is activated and GRAY_ON is deactivated. With GRAY_ON deactivated, the switch S1 is opened, and with VCIR activated, the output of the XOR gate (84) is gated to the switch S2. Since the current and previous MSBs are the same (i.e., CD[5]=0 and PD[5]=0), the output of the AND gate is logic "0" which maintains S2 in a state of deactivation. With S2 deactivated, the source driver output signal Sn remains at VG[7] (i.e., not charged to VG[31]) during period P5. Thereafter, after time T6, VCIR is deactivated and GRAY_ON is activated. With CD[5:0]=19H, the first driver (26) drives Sn to VG[25].

It is to be appreciated that the exemplary source driving circuits and methods described with reference to FIGS. 8, 9 and 10 provide a significant savings in power consumption as compared to the conventional circuits and methods described above with reference to FIGS. 2, 3 and 4. More specifically, by way of example with reference to FIG. 9, in period P1, the use of VCI power to partially drive the data line Di provides a reduction in power consumption as compared to the conventional method of FIG. 3 where boosted power AVDD is only used to drive the data line. Moreover, in period P3, the use of the VCI power to drive the data line results in a charge recycling operation due to the "negative" current to the VCI power supply.

Figure 4:
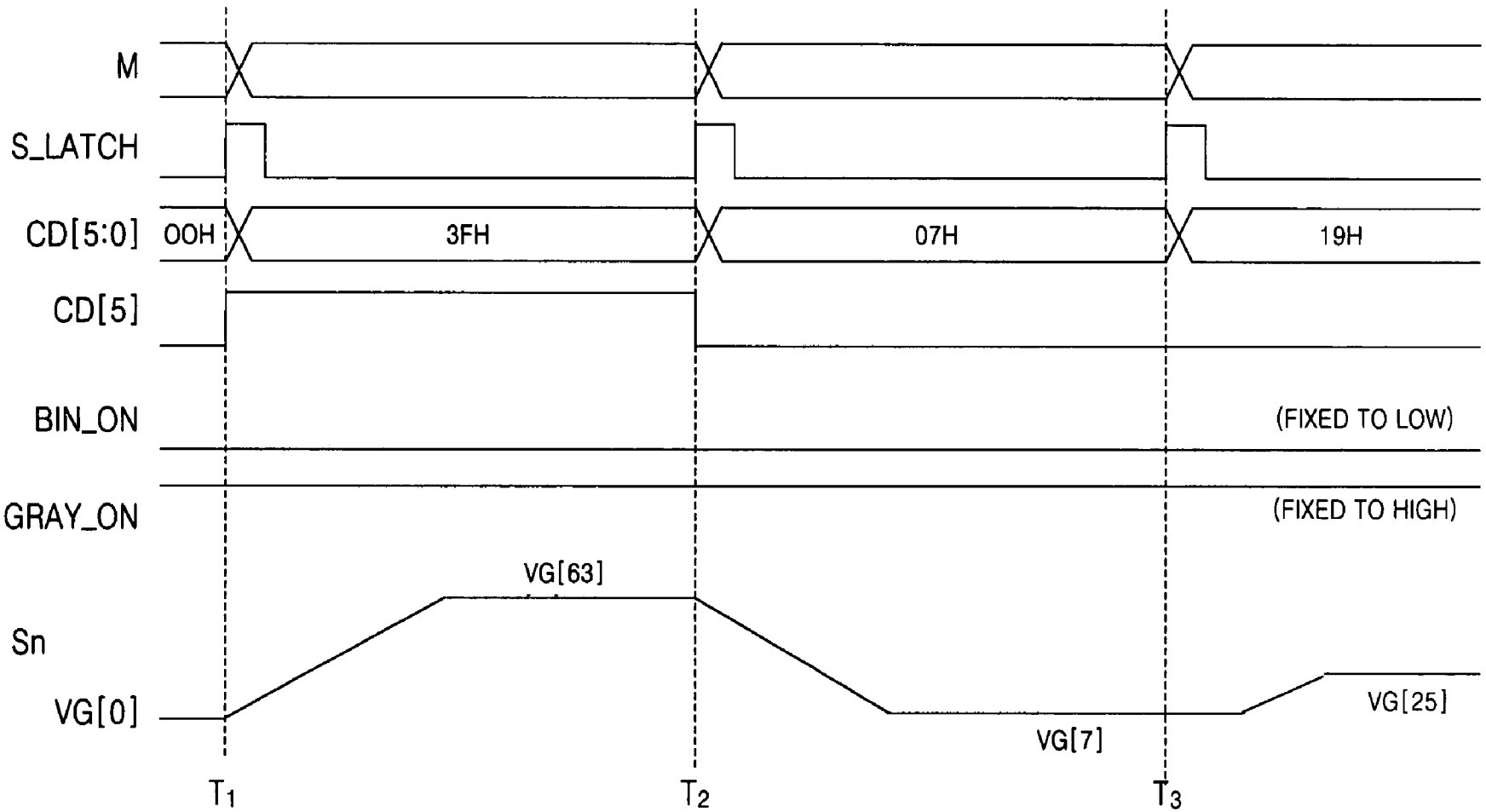
FIG. 4 (PRIOR ART)
FIG. 4 is a timing diagram illustrating a gradient mode of operation of the source driver circuit of FIG. 2.

Furthermore, in FIG. 10, the exemplary gradient mode of operation provides a significant reduction in power consumption as compared to the conventional method of FIG. 4 due to the use of VCI power for the third driver (91). In particular, in FIG. 10, the use of VCI (non-boosted) power by the third driver (91) to drive the data line to VG[31] reduces power consumption in period P1 and the negative current to VCI power in period P3 results in a charge recycling operation.

More specifically, by way of example, assume $I_D$ is the total driving current from AVSS to AVDD, wherein the driving currents in periods $P_1$ and $P_2$ are $I_{D1}$ and $I_{D2}$, respectively, such that $I_D=I_{D1}+I_{D2}$. With the exemplary method of FIG. 9, where VCI power is used, in part, to drive the data lines, assuming AVSS=0V and assuming AVDD=α·VCI, the total driving power consumption in periods P1 and P2 is:

$$P=(I_{D1}\cdot(VCI-AVSS))+(I_{D2}(AVDD-VCI))$$

$$P=(I_{D1}\cdot VCI)+[(I_{D2}\cdot(VCI\cdot\alpha))-I_{D2}\cdot(VCI)]$$

$$P=VCI\cdot(I_{D1}-I_{D2}+(\alpha I_{D2})).$$

Figure 3:
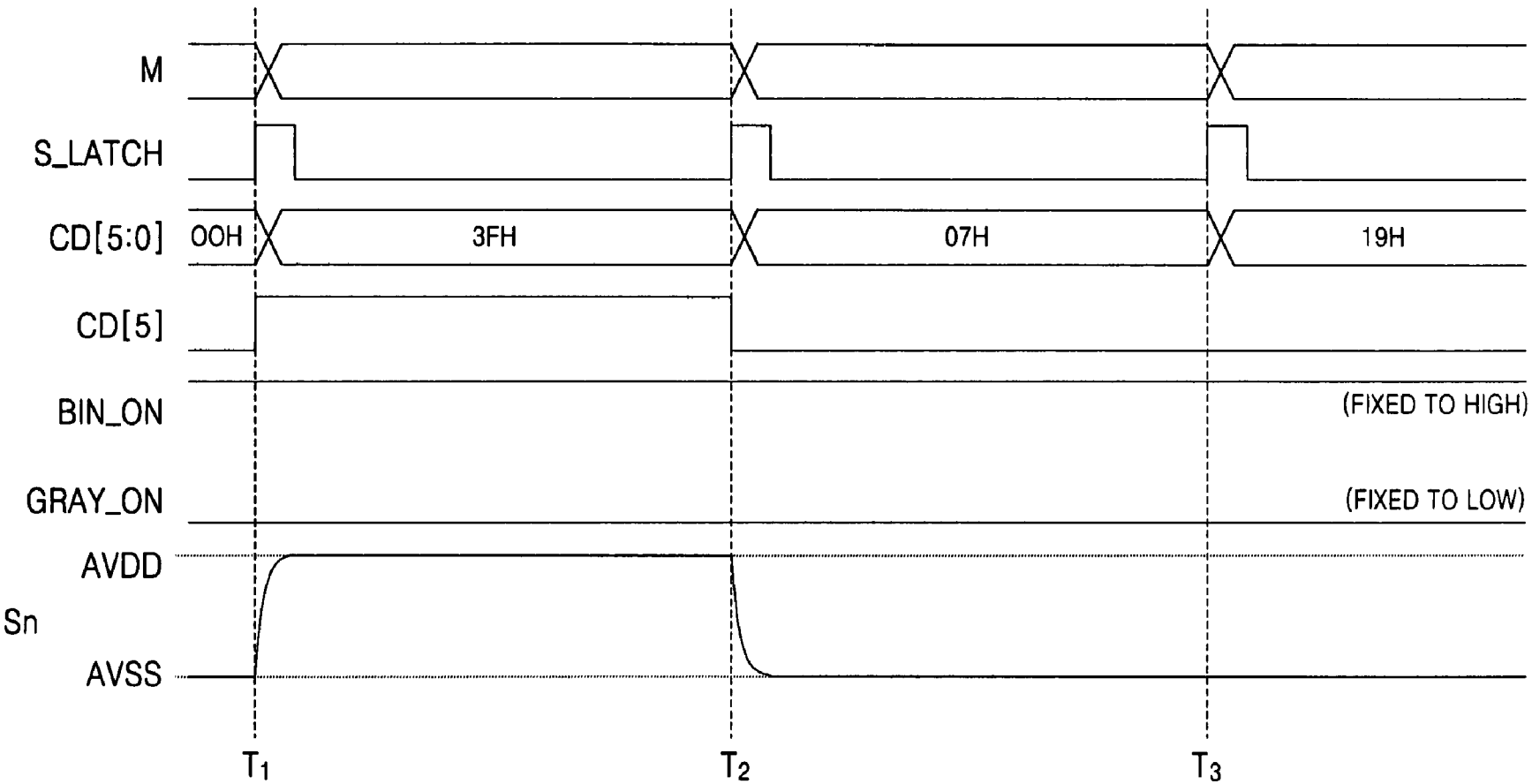
FIG. 3 (PRIOR ART)
FIG. 3 is a timing diagram illustrating a binary mode of operation of the source driver circuit of FIG. 2.

In contrast, with the conventional method of FIG. 3, the total driving power consumption in periods P1 and P2 is:

$$P'=I_D\cdot(AVDD-AVSS)=I_DAVDD=I_D\cdot(\alpha\cdot VCI)=VCI\cdot(\alpha I_{D1}+\alpha I_{D2})$$

Assuming the total driving current remains the same for the conventional and exemplary methods, we see a reduction in power consumption with the exemplary method as compared to the conventional method since:

$$VCI\cdot(\alpha I_{D1}+\alpha I_{D2})>VCI\cdot(I_{D1}-I_{D2}+(\alpha I_{D2}))\text{ when }\alpha>1,$$

Therefore, with the exemplary methods of FIGS. 9 and 10, the use of VCI power during period P1 results in 1/α power consumption as compared to the conventional method (for α>1) . Moreover, as noted above, charge recycling occurs due to the negative current to the VCI power in period P3.

Figure 5:
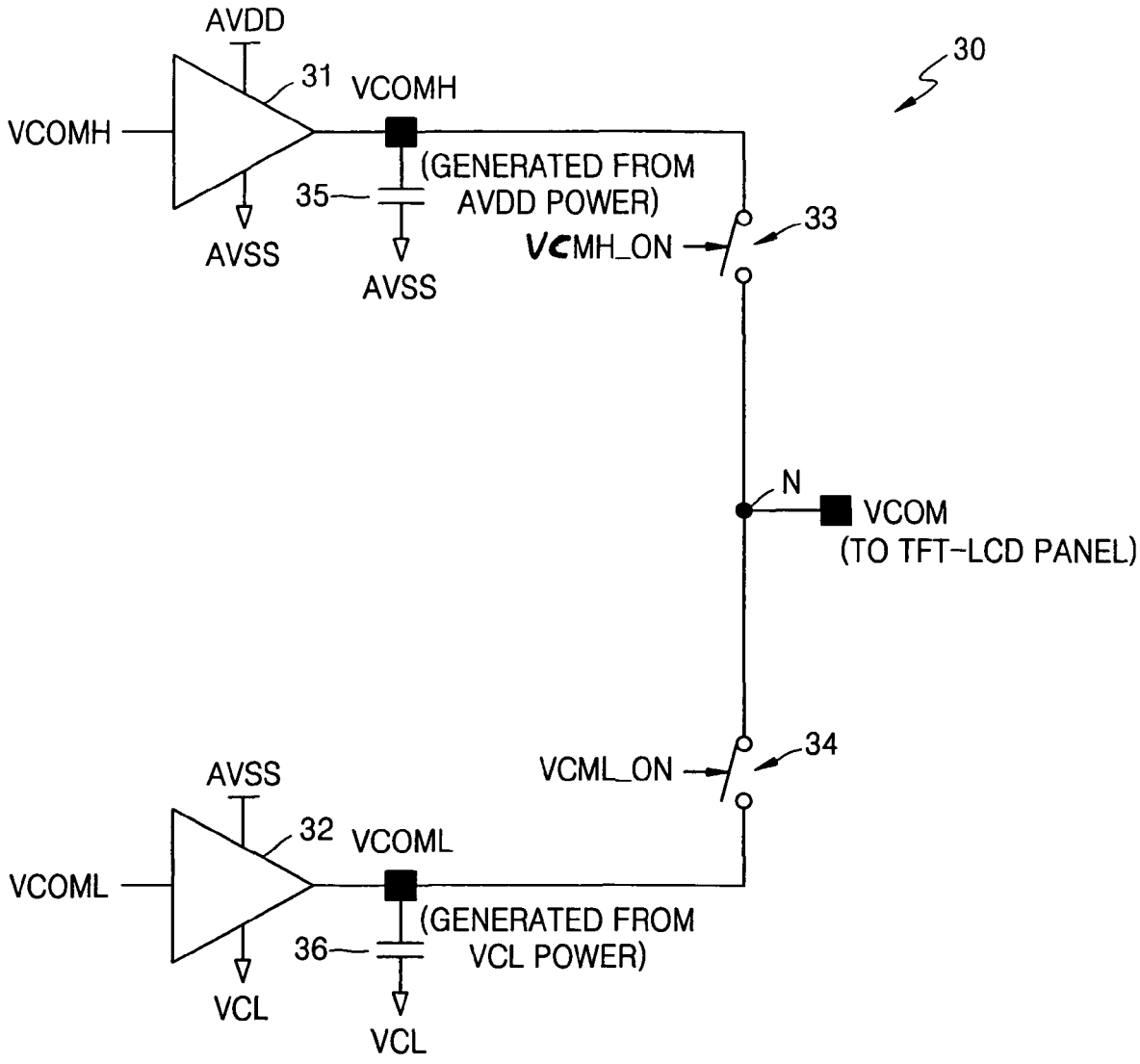
FIG. 5 (PRIOR ART)
FIG. 5 is a schematic diagram that illustrates a conventional VCOM (common voltage electrode) driver circuit.
Figure 11:
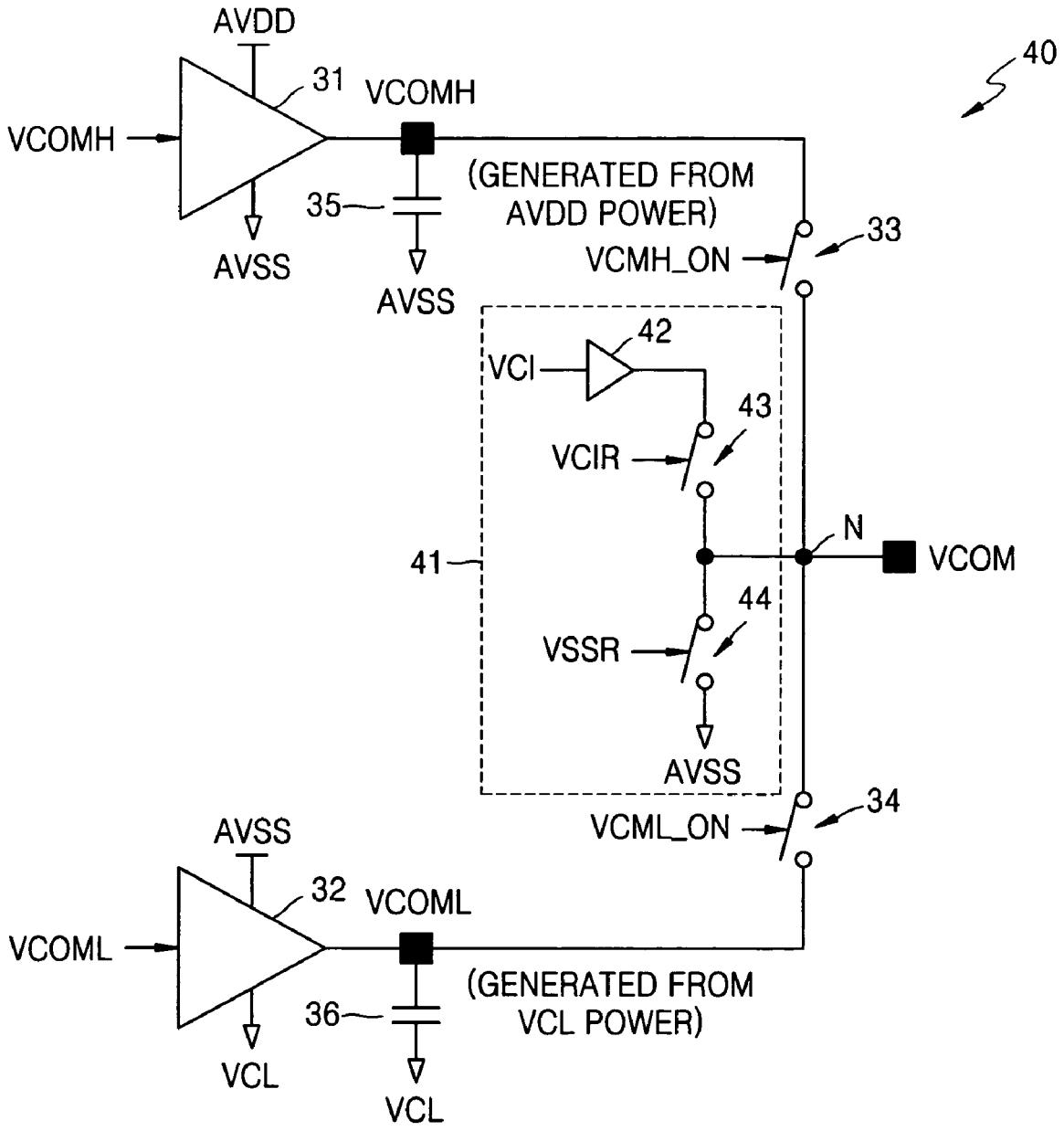
FIG. 11 is a schematic diagram that illustrates a VCOM (common voltage electrode) driver circuit according to an exemplary embodiment of the invention.

FIG. 11 illustrates a common voltage driver circuit (40) according to an exemplary embodiment of the invention. The common voltage driver circuit (40) is similar to the driver circuit (30) of FIG. 5 in that the circuit (40) comprises first and second drivers (31) and (32), switches (33) and (34) and capacitors (35) and (36), which operate the same as described above. The common voltage driver circuit (40) comprises an intermediate voltage output circuit (41) that outputs one or more intermediate common voltages to the common electrode (VCOM) node N, in response to one or more intermediate control signals.

More specifically, in one exemplary embodiment as depicted in FIG. 11, the intermediate voltage output circuit (41) comprises a third driver (42) that buffers and outputs the reference voltage VCI, and switches (43) and (44) that are controlled by intermediate voltage control signals VCIR and VSSR, respectively. The switch (43) is controlled to connect the output of driver (42) to the VCOM node N and the switch (44) is controlled to connect the VCOM node N to a ground voltage AVSS. In one exemplary embodiment of the invention, VCOMH is about 4 volts, VCI is about 2-3V, AVSS is 0 v (ground) and VCOML is about −1V. As discussed below with reference to FIG. 12, a method of driving the common electrode using the driver circuit (40) of FIG. 11 provides a significant decrease in power consumption as compared to the driving circuit (30) of FIG. 5 for driving the common electrode.

Figure 12:
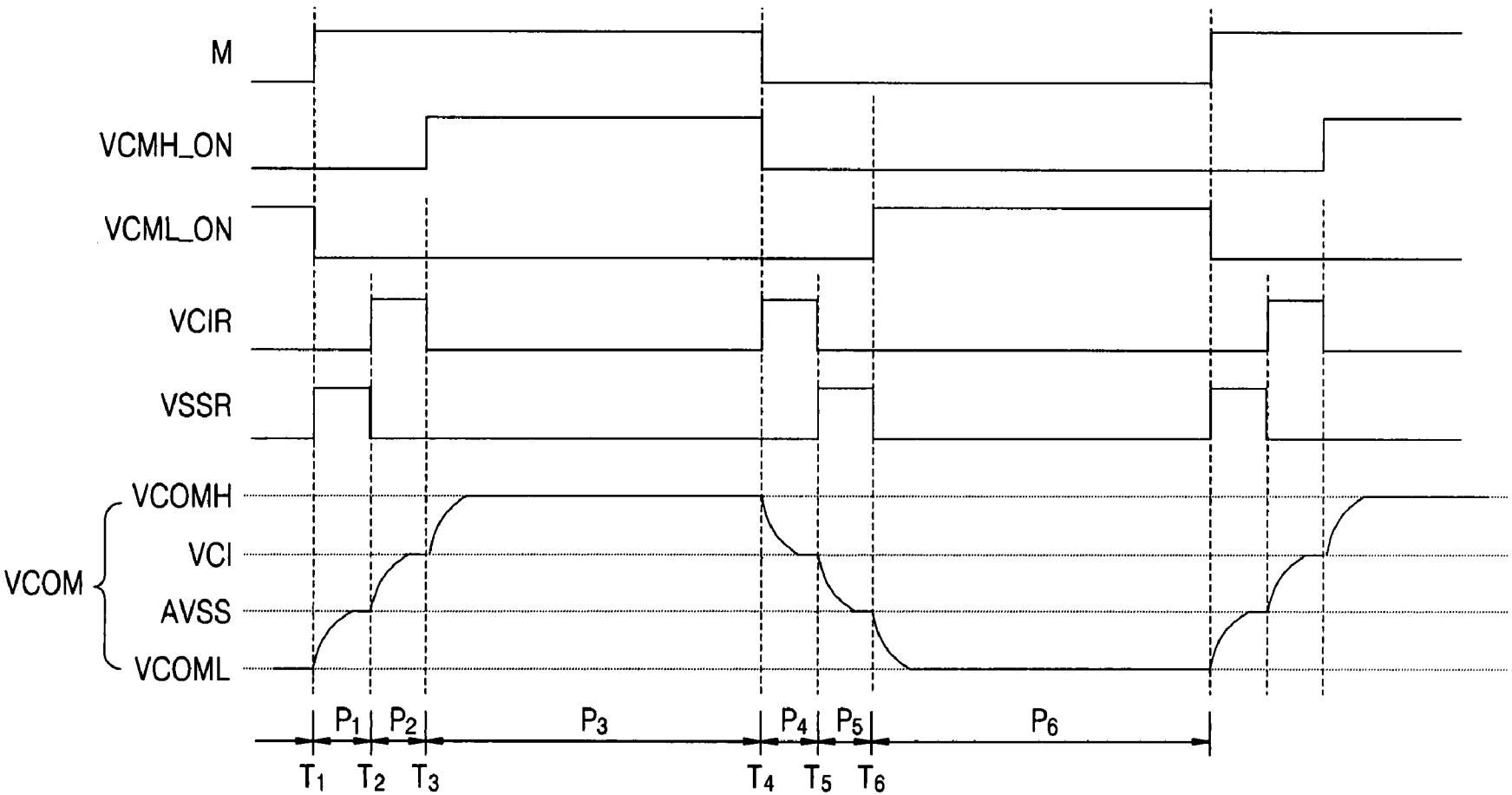
FIG. 12 is an exemplary timing diagram illustrating a mode of operation of the VOM driver of FIG. 11.

FIG. 12 is an exemplary timing diagram illustrating a method for driving a common electrode according to an exemplary embodiment of the invention. More specifically, FIG. 12 illustrates a mode of operation of the common voltage driver (40) of FIG. 11. Referring to FIG. 12, in the time period before time T1, with polarity control signal M at logic level "0", the control signal VCML_ON is enabled (switch (34) is closed) and control signals VCMH_ON, VCIR and VSSR are disabled (switches 33, 43 and 44 are open). Accordingly, the common voltage VCOM is driven to VCOML by the second driver (32).

At time T1, the polarity control signal M switches to logic level "1" to invert the display data, VCML_ON is disabled causing the switch (34) to open, and control signal VSSR is enabled causing the switch (44) to close and connect the VCOM node N to an intermediate voltage (AVSS) (e.g., ground, 0V). During time period P1, VCOM is driven from VCOML to AVSS. Then, at time T2, VSSR is disabled causing the switch (44) to open and VCIR is enabled causing the switch (43) to close and connect the VCOM node N to the output of the third driver (42). Accordingly, during time period P2, VCOM is driven from AVSS to the intermediate voltage VCI using VCI power supply. Then, at time T3, VCIR is disabled causing the switch (43) to open and control signal VMH_ON is enabled causing switch (33) to close and connect the output of the first driver (31) to the VCOM node N. Accordingly, during time period P3, VCOM is driven from the intermediate voltage VCI to VCOMH by the first driver (31).

Then, at time T4, the polarity control signal M switches to logic "0" indicating display data having a "positive" polarity, the control voltage VCMH_ON is disabled causing the switch (33) to open, and control signal VCIR is enabled causing the switch (43) to close and connect the VCOM node N to the output of the third driver (42). Accordingly, during time period P4, VCOM is driven from VCOMH to VCI by the driver (42). Then, at time T5, VCIR is disabled causing switch (43) to open, and VSSR is enabled causing switch (44) to close and connect the VCOM node N to ground (AVSS). Accordingly, during time period P5, VCOM is driven from VCI to VSS. Then, at time T6, VSSR is disabled causing the switch (44) to open, and VCML_ON is enabled causing switch (34) to close and connect the VCOM node N to the output of the second driver (32). According, during period P6, VCOM is driven from intermediate voltage AVSS to VCOML.

Figure 6:
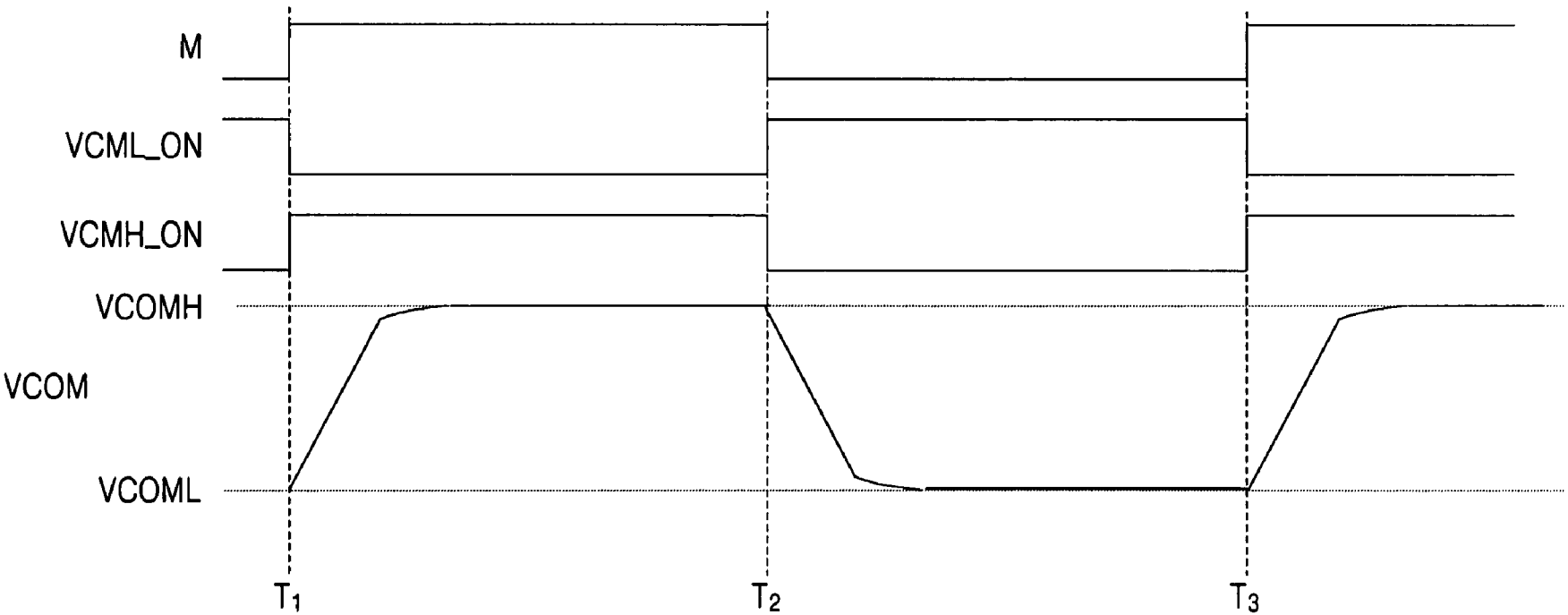
FIG. 6 (PRIOR ART)
FIG. 6 is a timing diagram illustrating a mode of operation of the VCOM driver of FIG. 5.
Figure 7:
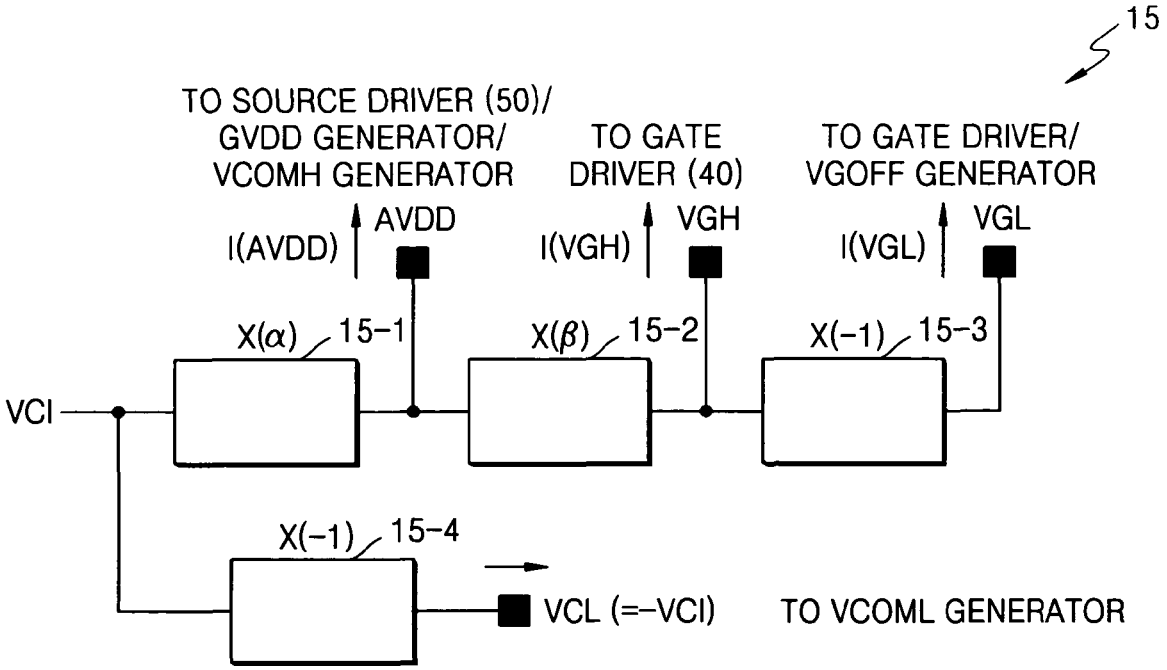
FIG. 7 (PRIOR ART)
FIG. 7 is a schematic diagram that illustrates a conventional power generator circuit for the display system of FIG. 1.

It is to be appreciated that the common voltage driving circuit and method of FIGS. 11 and 12 provide a significant reduction in the power consumption as compared to the conventional common voltage driving circuit and method of FIGS. 6 and 7. For instance, in period P1, no power is consumed by using ground to drive VCOM from VCOML (e.g., −1 v) to AVSS (e.g., 0 v). Moreover, in period P2, driving VCOM from AVSS (ground) to VCI using the VCI power supply as opposed to the boosted AVDD power results in a $1/\alpha$ reduction in power consumption for the reasons described above. Moreover, in time period P4, a charge recycling operation occurs due to the "negative" current supply to the VCI power supply. Further, in period P5, no power is consumed by sinking VCI to AVSS using ground.

Although exemplary embodiments have been described herein with reference to the accompanying drawings, it is to be understood that the invention is not limited to the precise system and method embodiments described herein, and that various other changes and modifications may be affected therein by one skilled in the art without departing form the scope or spirit of the invention. All such changes and modifications are intended to be included within the scope of the invention as defined by the appended claims.

What is claimed is:

1. A source driving circuit for driving a data line of a display, comprising:

a source driver circuit that receives display data and generates a source driving voltage corresponding to the received display data, and applies the source driving voltage to a data line of a display;

a voltage generator circuit that generates an intermediate source driving voltage, wherein the intermediate source driving voltage is a first intermediate voltage in a first mode of operation and the intermediate source driving voltage is a second intermediate voltage lower than the first intermediate voltage in a second mode of operation; and a control circuit that applies the intermediate source driving voltage to the data line to drive the data line when the received display data is different from previously received display data before the source driving voltage is applied to the data line by the source driver circuit to drive the data line, wherein the intermediate source driving voltage is in a range of ½ to ⅓ of a full-swing voltage of the source driving voltage, wherein in the first mode of operation the source driving voltage is either a power supply voltage or a ground voltage and in the second mode of operation the source driving voltage is a grayscale voltage.

2. The circuit of claim 1, wherein the control circuit comprises:

a comparator that compares the received display data with previously received display data, and generates a comparison signal;

a switch that is responsive to the comparison signal to selectively apply the intermediate source driving voltage from the voltage generator circuit to the data signal line.

3. The circuit of claim 2, wherein the control circuit further comprises a latch that outputs the previously received display data to the comparator.

4. The circuit of claim 2, wherein the comparator compares a most significant bit of the received display data with a most significant bit of the previously received display data.

5. The circuit of claim 4, wherein the comparator generates a control signal to deactivate the switch when the most significant bits of the received display data and the previously received display data are the same.

6. The circuit of claim 4, wherein the comparator comprises an exclusive OR gate that receives as input the most significant bit of the received display data and the most significant bit of the previously received display data.

7. The circuit of claim 2, further comprising a gate circuit that is responsive to a gate control signal to selectively apply the comparison signal to the switch.

8. The circuit of claim 1, wherein the source driver circuit is enabled by a first control signal to apply the source driving voltage to the data line, wherein the control circuit is enabled by a second control signal to apply the intermediate source driving voltage to the data line, and wherein the first and second control signals are exclusively activated such that the intermediate source driving voltage is applied to the data line before the source driving voltage is applied to the data line.

9. The circuit of claim 1, wherein the intermediate source driving voltage output from the voltage generator is a grayscale reference voltage.

10. A circuit for driving a data line of a display, comprising:

a polarity control circuit that receives an n-bit display signal and a polarity control signal, and either reverses or maintains a polarity of the n-bit display signal in response to the polarity control signal;

a first latch that latches the n-bit display signal output from the polarity control circuit in response to a first latch control signal;

a decoder that receives as input a plurality of gray scale reference voltages and the n-bit display signal output from the first latch, and decodes the n-bit display signal to selectively output one of the gray scale reference voltages;

a buffer circuit that generates a source driving voltage and applies the source driving voltage to a data line of a display;

a voltage generator circuit that generates an intermediate source driving voltage, wherein the intermediate source driving voltage is a first intermediate voltage in a first mode of operation and the intermediate source driving voltage is a second intermediate voltage lower than the first intermediate voltage in a second mode of operation; and a control circuit that applies the intermediate source driving voltage to the data line to drive the data line when the received display data is different from previously received display data before the source driving voltage is applied to the data line by the buffer circuit to drive the data line, wherein the intermediate source driving voltage is in a range of ½ to ⅓ of a full-swing voltage of the source driving voltage, wherein in the first mode of operation the source driving voltage is either a power supply voltage or a ground voltage and in the second mode of operation the source driving voltage is a grayscale voltage.

11. The circuit of claim 10, wherein the control circuit comprises:

a comparator that compares the most significant bit of the n-bit display signal with a most significant bit of a previously received n-bit display signal, and generates a comparison signal in response thereto;

a switch that is responsive to the comparison signal to selectively apply the intermediate source driving voltage to the data signal line.

12. The circuit of claim 11, wherein the control circuit further comprises a one-bit latch that latches and outputs the most significant bit of the previously received n-bit display signal to the comparator.

13. The circuit of claim 11, wherein the comparator comprises an exclusive OR gate.

14. The circuit of claim 11, further comprising a gate circuit that is responsive to a gate control signal to selectively output the comparison signal to the switch.

15. The circuit of claim 11, wherein the comparison signal deactivates the switch when the most significant bits of the received n-bit display signal and the previously received n-bit display signal are the same.

16. The circuit of claim 10, wherein the buffer circuit is enabled by either the first or second mode control signal to apply the source driving voltage to the data line, wherein the control circuit is enabled by a control signal to apply the intermediate source driving voltage to the data line, and wherein the control signal is exclusively activated with respect to the first or second mode control signal such that the intermediate source driving voltage is applied to the data line before the source driving voltage is applied to the data line.

17. The circuit of claim 10, wherein the voltage generator circuit comprises:

an intermediate voltage driver; and a switch, wherein the switch is controlled by a switch control signal to connect to a first node or a second node, wherein the first node is coupled to an intermediate voltage power supply and the second node is coupled to an output of the intermediate voltage driver.

18. The circuit of claim 17, further comprising a capacitor connected between the second node and ground.

19. The circuit of claim 17, wherein the voltage generator circuit outputs a first voltage, which is generated by the intermediate voltage power supply, as the intermediate source driving voltage in the second mode of operation, and wherein the voltage generator outputs a second voltage, which is generated by the intermediate voltage driver, as the intermediate source driving voltage in the first mode of operation.

20. The circuit of claim 19, wherein the intermediate voltage driver operates by using the first voltage generated by the intermediate voltage power supply.

21. The circuit of claim 20, wherein the intermediate voltage driver buffers and outputs a grayscale reference voltage as the second voltage that is used as an intermediate source driving voltage.

22. A liquid crystal display apparatus, comprising:

a liquid crystal display panel having a plurality of thin film transistors, a plurality of gate lines connected to gate electrodes of the thin film transistors, a plurality of data lines connected to source electrodes of the thin film transistors;

a gate driver comprising a plurality of gate driver circuits, wherein each gate driver circuit drives a corresponding gate line of the liquid crystal display panel;

a source driver comprising a plurality of source driver circuits, wherein each source driver circuit drives a corresponding data line of the liquid crystal display panel by generating a source driving voltage corresponding to received display data, and applying the source driving voltage to the data line; and a voltage generator circuit that generates an intermediate source driving voltage that is commonly applied to each source driver circuit, wherein the intermediate source driving voltage is a first intermediate voltage in a first mode of operation and the intermediate source driving voltage is a second intermediate voltage lower than the first intermediate voltage in a second mode of operation;

wherein each source driver circuit comprises a control circuit that applies the intermediate source driving voltage to the corresponding data line to drive the corresponding data line when the received display data is different from previously received display data before the source driving voltage is applied to the data line by the source driver circuit to drive the data line, wherein the intermediate source driving voltage is in a range of ½ to ⅓ of a full-swing voltage of the source driving voltage, and wherein in the first mode of operation the source driving voltage is either a power supply voltage or a ground voltage and in the second mode of operation the source driving voltage is a grayscale voltage.

23. The apparatus of claim 22, wherein the control circuit comprises:

a comparator that compares the received display data with previously received display data, and generates a comparison signal;

a switch that is responsive to the comparison signal to selectively apply the intermediate source driving voltage from the voltage generator circuit to the data signal line.

24. The apparatus of claim 23, wherein the control circuit further comprises a latch that outputs the previously received display data to the comparator.

25. The apparatus of claim 23, wherein the comparator compares a most significant bit of the received display data with a most significant bit of the previously received display data.

26. The apparatus of claim 25, wherein the comparator generates a control signal to deactivate the switch when the most significant bits of the received display data and the previously received display data are the same.

27. The apparatus of claim 25, wherein the comparator comprises an exclusive OR gate that receives as input the most significant bit of the received display data and the most significant bit of the previously received display data.

28. The apparatus of claim 23, wherein the control circuit further comprises a gate circuit that is responsive to a gate control signal to selectively apply the comparison signal to the switch.

29. The apparatus of claim 22, wherein the source driver circuit is enabled by a first control signal to apply the source driving voltage to the data line, wherein the control circuit is enabled by a second control signal to apply the intermediate source driving voltage to the data line, and wherein the first and second control signals are exclusively activated such that the intermediate source driving voltage is applied to the data line before the source driving voltage is applied to the data line.

30. The apparatus of claim 22, wherein the intermediate source driving voltage output from the voltage generator is a grayscale reference voltage.

31. A method for driving a data line of a display, comprising the steps of:

generating a source driving voltage corresponding to received display data;

generating an intermediate source driving voltage, wherein the intermediate source driving voltage is a first intermediate voltage in a first mode of operation and the intermediate source driving voltage is a second intermediate voltage lower than the first intermediate voltage in a second mode of operation;

applying the intermediate source driving voltage to a data line to drive the data line when the received display data is different from previously received display data before the source driving voltage is applied to the data line; and applying the source driving voltage to the data line to drive the data line from the intermediate source driving voltage to the source driving voltage, wherein the intermediate source driving voltage is in a range of ½ to ⅓ of a full-swing voltage of the source driving voltage, wherein in the first mode of operation the source driving voltage is either a power supply voltage or a ground voltage and in the second mode of operation the source driving voltage is a grayscale voltage.

* * * * *